US010786965B2

(12) United States Patent
Walsh

(10) Patent No.: US 10,786,965 B2
(45) Date of Patent: Sep. 29, 2020

(54) HEAT-ASSISTED CARTON FORMATION

(71) Applicant: Graphic Packaging International, Inc., Atlanta, GA (US)

(72) Inventor: Joseph C. Walsh, Boulder, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 1025 days.

(21) Appl. No.: 14/085,912

(22) Filed: Nov. 21, 2013

(65) Prior Publication Data

US 2014/0155239 A1 Jun. 5, 2014

Related U.S. Application Data

(60) Provisional application No. 61/797,141, filed on Nov. 30, 2012.

(51) Int. Cl.

| | |
|---|---|
| ***B31B 50/36*** | (2017.01) |
| *B31B 50/74* | (2017.01) |
| *B31B 100/00* | (2017.01) |

(52) U.S. Cl.

CPC ..... *B31B 50/36* (2017.08); *B31B 50/741* (2017.08); *B31B 2100/00* (2017.08)

(58) Field of Classification Search

CPC ..... B31B 1/74; B31B 2201/61; B31B 50/36; B31B 50/741; B31B 2100/00; B31F 1/36

USPC .... 493/129, 128, 127, 131, 133, 134, 69, 79

See application file for complete search history.

(56) References Cited

U.S. PATENT DOCUMENTS

| | | | | |
|---|---|---|---|---|
| 2,822,653 | A * | 2/1958 | Zinn, Jr. | B65B 51/16 198/793 |
| 2,876,555 | A * | 3/1959 | Vander Pyl, Jr. | B01D 39/18 156/474 |
| 3,064,542 | A | 11/1962 | Terry | |
| 3,079,845 | A | 3/1963 | Powell | |
| 3,153,374 | A | 10/1964 | Borkmann et al. | |
| 3,158,073 | A * | 11/1964 | Rumberger | B26D 3/08 229/5.85 |
| 3,186,143 | A * | 6/1965 | Borkmann | B65B 51/10 53/370.6 |
| 3,207,049 | A | 9/1965 | Monroe et al. | |
| 3,227,352 | A * | 1/1966 | Striplin | B31B 7/00 229/164.2 |
| 3,248,841 | A | 5/1966 | Heffelfinger et al. | |
| 3,280,535 | A | 10/1966 | Reimers et al. | |
| 3,364,826 | A | 1/1968 | Austin, Jr. et al. | |

(Continued)

FOREIGN PATENT DOCUMENTS

| | | | |
|---|---|---|---|
| CN | 101395070 | A | 3/2009 |
| CN | 102216067 | A | 10/2011 |

(Continued)

OTHER PUBLICATIONS

International Search Report and Written Opinion for PCT/US2013/071134 dated Mar. 4, 2014.

(Continued)

*Primary Examiner* — Dariush Seif

(74) *Attorney, Agent, or Firm* — Womble Bond Dickinson (US) LLP

(57) ABSTRACT

A method of at least partially forming a carton includes obtaining a blank comprising at least one fold line, heating an interior surface of the blank along the at least one fold line to form a heated fold line, and folding the blank about the heated fold line.

17 Claims, 8 Drawing Sheets

(56) References Cited

U.S. PATENT DOCUMENTS 3,379,102 A * 4/1968 James ..... B31B 7/00 229/162.2
3,404,257 A 10/1968 Hoff
3,426,506 A 2/1969 Jernigan
3,476,022 A 11/1969 Scully
3,486,423 A 12/1969 Mistarz
3,537,361 A 11/1970 Derderian et al.
3,555,975 A * 1/1971 Barnes ..... B31B 3/00 493/164
3,597,900 A * 8/1971 Scott ..... B29C 65/10 493/135
3,604,317 A * 9/1971 Baun ..... B29C 66/02241 229/190
3,751,876 A * 8/1973 Oakley ..... B29C 65/103 156/282
3,753,333 A 8/1973 Derderian et al.
3,800,677 A * 4/1974 Jones ..... B31B 1/00 493/10
4,002,417 A * 1/1977 Vecchiotti ..... B29C 53/04 264/296
4,012,998 A 3/1977 Daugherty et al.
4,123,966 A 11/1978 Buschor
4,164,171 A 8/1979 Meyers et al.
4,256,919 A * 3/1981 Berg ..... F27D 11/04 164/122
4,367,117 A * 1/1983 Seaborn ..... B65B 25/002 156/217
4,545,780 A 10/1985 Martin
4,608,039 A * 8/1986 Ferri, Jr. ..... B31B 41/00 156/227
4,701,587 A * 10/1987 Carter ..... B23K 3/0475 219/233
4,708,708 A * 11/1987 Fries, Jr. ..... B24B 9/002 409/138
4,762,488 A * 8/1988 Schilling ..... F23D 14/64 431/350
4,779,400 A * 10/1988 Hoskinson ..... B65B 9/087 53/374.8
4,819,411 A * 4/1989 Konzal ..... B65B 61/24 53/113
4,838,009 A 6/1989 Connor et al.
4,979,932 A * 12/1990 Burnside ..... B31B 1/00 493/134
5,088,973 A * 2/1992 Bruce ..... B65H 45/30 493/396
5,221,346 A * 6/1993 Anderson ..... B05C 5/0204 118/405
5,230,204 A 7/1993 Hall et al.
5,236,408 A * 8/1993 McAdam, III ..... B29C 65/10 493/135
5,302,227 A * 4/1994 Dalrymple ..... B65B 7/26 156/204
5,359,285 A * 10/1994 Hashinaga ..... G01R 31/2874 165/80.3
5,580,097 A * 12/1996 Latvakangas ..... B42D 3/002 281/21.1
5,716,473 A * 2/1998 Gordon ..... B65D 5/18 156/200
5,800,329 A * 9/1998 Fager ..... B31B 1/58 493/417
5,980,440 A 11/1999 Mitman et al.
6,042,527 A 3/2000 Anderson et al.
6,554,182 B1 4/2003 Magnusson et al.
7,137,941 B2 11/2006 Gamache et al.
7,708,679 B2 5/2010 Cailloux
8,162,135 B2 4/2012 Oliveira
8,356,744 B2 1/2013 Brand et al.
8,894,808 B2 * 11/2014 Seiche ..... B31B 1/26 156/226
2001/0038721 A1 * 11/2001 Bois ..... B31B 19/36 383/64
2006/0046916 A1 * 3/2006 Gamache ..... B31B 1/00 493/135
2007/0167304 A1 * 7/2007 Selle ..... B29C 65/10 493/175
2007/0197363 A1 * 8/2007 Parrotta ..... B29C 53/063 493/68
2008/0048367 A1 * 2/2008 Falat ..... B29C 53/06 264/442
2008/0085824 A1 * 4/2008 Sprandel ..... B31B 1/00 493/399
2008/0171644 A1 7/2008 Cailloux et al.
2009/0264271 A1 10/2009 Wiklund
2012/0071312 A1 * 3/2012 Seiche ..... B31B 1/26 493/467
2013/0042580 A1 2/2013 May et al.

FOREIGN PATENT DOCUMENTS

CN 102282080 A 12/2011
EP 0 256 172 A2 2/1988

OTHER PUBLICATIONS

Supplementary European Search Report for EP 13 85 9215 dated Dec. 5, 2016.
Notification of the First Office Action for CN 201380061235.5 dated Jun. 1, 2016, with English translation.

* cited by examiner

HEAT-ASSISTED CARTON FORMATION

CROSS-REFERENCE TO RELATED APPLICATIONS

This application claims the benefit of U.S. Provisional Patent Application No. 61/797,141 filed Nov. 30, 2012.

INCORPORATION BY REFERENCE

The disclosure of U.S. Provisional Patent Application No. 61/797,141, which was filed on Nov. 30, 2012, is hereby incorporated by reference for all purposes as if presented herein in their entirety.

BACKGROUND OF THE DISCLOSURE

The present disclosure generally relates to methods of forming cartons. More specifically, the present disclosure relates to heat-assisted formation of cartons.

SUMMARY OF THE DISCLOSURE

In general, one aspect of the disclosure is directed to a method of at least partially forming a carton. The method includes obtaining a blank comprising at least one fold line, heating an interior surface of the blank along the at least one fold line to form a heated fold line, and folding the blank about the heated fold line.

In another aspect, the present disclosure is generally directed to a system for forming a carton from a blank. The system includes a conveyor for transporting at least one blank within the system. The at least one blank has an interior surface and at least one fold line defined thereon. The system further includes a heater configured to apply heat to the interior surface proximate the at least one fold line to form a heated fold line of the blank, and a folding mechanism for folding the heated fold line of the blank.

In another aspect, the present disclosure is generally directed to a method of improving visual quality of an outer surface of a carton assembled from a coated paperboard blank. The method includes obtaining a blank having an inner surface, an outer surface, the outer surface having a coating applied thereon, a first side panel foldably connected to a second side panel at a first fold line, and an attachment flap foldably connected to the second side panel at a second fold line. The method further includes heating an interior surface of the blank along the first fold line to form a first heated fold line, and positioning the first side panel to be in at least partial face-to-face contact with the second side panel by folding the blank at the first heated fold line. The method further includes heating the interior surface of the blank along the second fold line to form a second heated fold line, positioning the attachment flap to at least partially overlap the first side panel by folding the blank at the second heated fold line, and adhering overlapping portions of the attachment flap and the first side panel.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to methods and systems for at least partially forming and packaging cartons for transport. The systems and methods may include heating a portion of a carton along at least one fold line to assist in folding the carton relative to the fold line or about the fold line while reducing surface anomalies such as cracks, tears, discoloration, and/or other defects apparent through conventional formation techniques.

Generally, cartons may be formed of blanks comprising cardboard, paperboard, or any other suitable material, and may include a coating or surface treatment on at least one surface thereof. Generally, clay coating is a common surface treatment applied to paper and paperboard at a mill. The clay coating is applied to the surface of paperboard to provide a smooth, single color (e.g., white) surface on which to print high resolution graphics. The clay coating is prone to cracking however, during scoring and folding of carton blanks. The cracking is exacerbated as the paperboard to be folded becomes thicker (i.e., thicker material forces the clay coating to stretch further during folding). Another type of surface coating is poly film. Certain types of poly film resist stretching and can crack during scoring and folding. However, upon application of heat assisted folding techniques as described herein, the film or clay coating can relax and stretch further to resist cracking.

Hereinafter, systems for at least partially forming a carton are described in detail.

Figure 1:
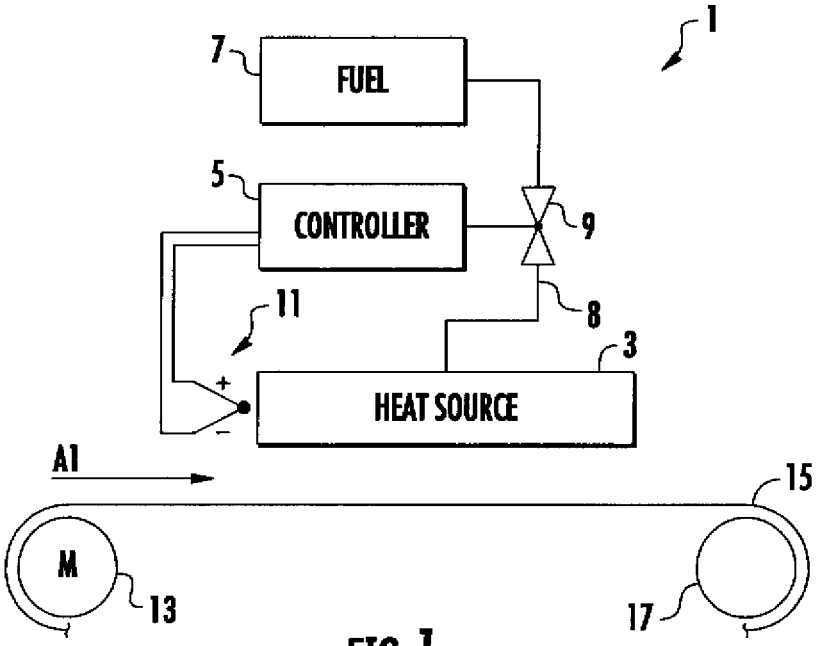
FIG. 1 is a system diagram, according to an embodiment of the disclosure.

Turning to FIG. 1, a system 1 for at least partially forming a carton is shown. The system 1 may include a heater 3 arranged to be in registration or alignment with at least one fold line of a blank for forming a carton. The heater 3 may include a suitable heater, including a gas or fuel/air heater comprising at least one open flame. The heater 3 is configured to heat an interior surface of a blank to within a predetermined range of temperatures. The heater 3 may alternatively include any other suitable heater, including electrical or resistive heaters without departing from the scope of this disclosure.

The system 1 further includes a controller 5 arranged to controllably increase/decrease a temperature of the heater 3. For example, according to one embodiment, the controller 5 is arranged to controllably increase/decrease a flow of fuel from fuel source 7 and fuel line 8 through control valve 9. The controller 5 may be any suitable controller, including, but not limited to, a dedicated programmable logic controller (PLC), a microcontroller, a computer processor, a computer apparatus, or any other suitable controller. The fuel source 7 may include any suitable fuel, including, but not limited to, electrical power, oil, methane, propane, natural gas, or any other fuel. The fuel source 7 may further include a dedicated combustion chemistry such as oxygen configured to further enhance combustion at heater 3 if open flames are used. The control valve 9 may include any suitable control mechanism, including, but not limited to, a solenoid valve, power transistor, electrical power controller, linear valve, butterfly valve, or any other mechanism or power-control structure. As further shown, temperature feedback may be received from a temperature measuring device 11 arranged proximate the heater 3. The temperature measuring device 11 may include any suitable device, including, but not limited to, a thermocouple, diode, metal-semiconductor junction, or any other suitable device. The controller 5, fuel source 7, control valve 9, and temperature measuring device 11 may be otherwise altered, configured, arranged, and/or omitted from the examples given and illustrated without departing from the scope of this disclosure.

The system 1 may further include at least one conveyor comprising a motor 13, a belt 15, and a roller 17. The motor 13 may be controlled through the controller 5 in some embodiments, or alternatively, may be controlled through any other suitable mechanism, including a variable frequency drive, direct drive, motor controller, and/or motor control relay. The motor 13 may be an alternating current powered motor in some embodiments, disposed to be powered with three-phase industrial electricity provided through a municipal power grid. The belt 15 may be any suitable belt, including a portion of a conveyor or automated folding mechanism configured to transport and fold a blank thereby at least partially forming a carton from said blank. The belt 15 may include adjustable tension and/or speed. The roller 17 may include a plurality of separate rollers in some embodiments. The roller 17, or the plurality of rollers, may be configured to route and guide belt 15 to facilitate an automated carton formation process. The roller 17, or the plurality of rollers, may include adjustable positioning, tensions, and/or speeds to further facilitate the automated carton formation process. The motor 13, belt 15, and roller 17 may be otherwise altered and/or omitted without departing from the scope of this disclosure.

Generally, the system 1 facilitates transfer of a blank for forming a carton proximate the heater 3 along direction A1. As the blank is transferred, a portion of the blank about, adjacent, or proximate a fold line is heated by the heater 3. This is described in more detail below with reference to FIGS. 2A-3C.

Figure 2A:
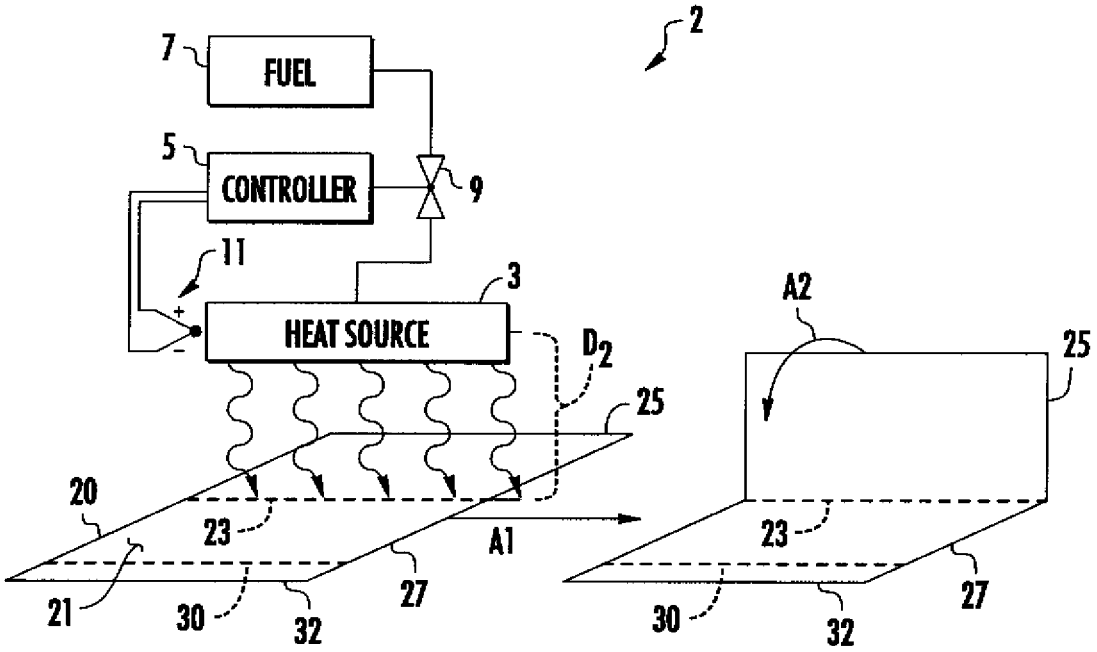
FIG. 2A is a schematic representation of the system of FIG. 1 partially forming a carton.

As shown in FIG. 2A, a blank 20 for forming a carton may be inserted into system 2. System 2 is substantially similar to system 1, but has been simplified for clarity of discussion. Cartesian coordinate axes L1, L2, and L3 are presented for relative discussion of distances and positioning. The blank 20 may include a first surface 21 (e.g., an interior surface) and a first fold line 23 arranged thereon. Generally, the first fold line 23 may be a substantially straight fold line according to some embodiments. The blank 20 further includes a first side panel 25 foldably connected to a second side panel 27 at the first fold line 23. In at least one embodiment, the blank 20 further includes an attachment flap 32 foldably connected to the second side panel 27 at a second fold line 30. The blank 20 may include more or less panels, attachment flaps, end flaps, and/or other features without departing from this disclosure.

The blank 20 may be inserted into the system 2 and arranged to travel proximate the heater 3 such that the fold line 23 is generally in registration with the heater 3. Generally, the blank 20 is inserted such that an uncoated interior surface is proximate the heater 3 and a coated outer surface is not proximate the heater 3. In this manner, the heater 3 is acting upon the uncoated surface. Additionally, the fold line 23 may be generally coplanar with the heater 3 according to some embodiments. As used herein, generally coplanar signifies that the fold line 23 or a significant portion thereof travels beneath the heater 3 while moving in direction A1. The heater 3 may be separated from the fold line 23 by a predetermined or desired distance $D_1$. The distance $D_1$ is an adjustable distance of separation which may be manipulated according to any desired implementation of the teachings herein.

As the blank 20 travels in the direction A1 through the system 2, heat from the heater 3 heats an area of the blank 20 proximate the fold line 23, thereby increasing pliability of a material comprising and/or coating the blank. The blank 20 may subsequently, or at substantially the same time, be folded about the fold line 23 along direction A2 such that the first side panel 25 of the blank 20 is pivoted relative to the second side panel 27. According to one embodiment, the first side panel 25 is folded at an angle to the second side panel 27. According to one embodiment, the first side panel 25 is folded and brought into face-to-face contact with the second side panel 27. Thereafter, or at substantially the same time, adhesive may be applied to one or more surfaces of the blank 20 to partially form at interior of a partially formed carton. The partially formed carton may thereafter be packaged for transport, for example, by repeatedly inserting partially formed cartons into a transport carrier such as a corrugated box, and be palletized. Application of adhesive and partial formation of the interior of a carton is described in more detail below, with reference to FIG. 2B, depicting an alternate embodiment.

Figure 2B:
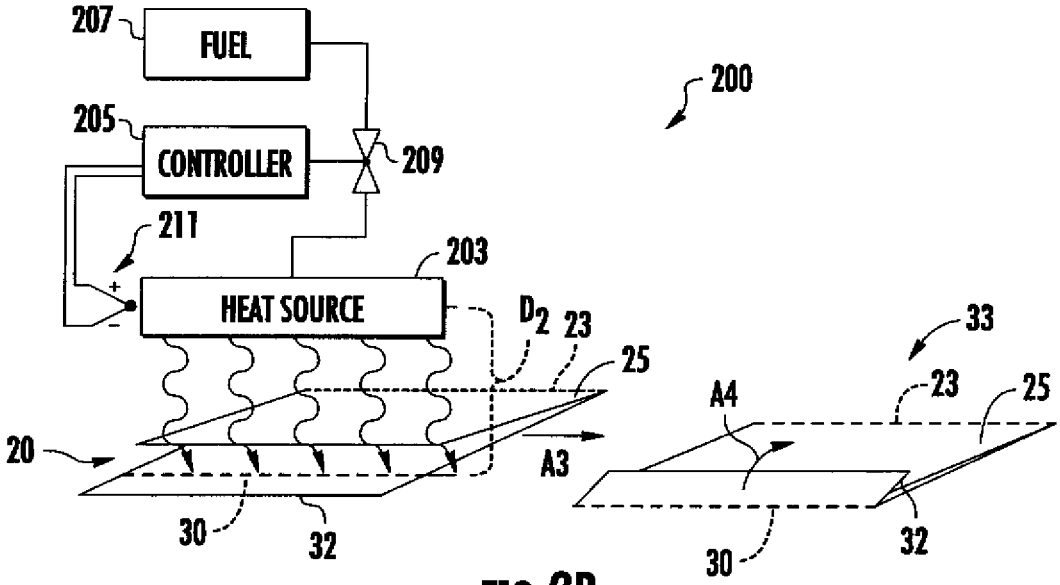
FIG. 2B is a schematic representation of an alternate system for further forming a carton.

Turning to FIG. 2B, a system 200 for partially forming a carton or sleeve of a carton is shown. The system 200 is substantially similar to the system 1 and 2, and may include a heater 203 arranged to be in registration or alignment with at least one fold line of a blank for forming a carton. The system 200 includes a controller 205 arranged to controllably increase/decrease a temperature of the heater 203. According to this embodiment, the controller 205 is arranged to controllably increase/decrease a flow of fuel from fuel source 207 and fuel line 208 through control valve 209. As further shown, temperature feedback may be received from temperature measuring device 211 arranged proximate the heater 203. The controller 205, fuel source 207, control valve 209, and temperature measuring device 2011 may be substantially similar to associated features of system 1, 2, and or may be integrated therewith.

As shown in FIG. 2B, the partially folded blank 20 may be inserted into system 200.

Alternatively, system 200 may be arranged to act in coordination with system 2 or may be fully or partially integrated therewith such that receipt of the partially folded blank 20 is uninterrupted. As the partially folded blank 20 travels proximate the heater 203 the fold line 30 is generally in registration with the heater 203. Generally, the partially folded blank 20 is inserted such that an uncoated interior surface is proximate the heater 3 and a coated outer surface is not proximate the heater 3. In this manner, the heater 3 is acting upon the uncoated surface. Additionally, the fold line 30 may be generally coplanar with the heater 203 according to some embodiments. The heater 203 may be separated from the fold line 30 by a predetermined or desired distance $D_2$. The distance $D_2$ is an adjustable distance of separation which may be manipulated according to any desired implementation of the teachings herein.

As the partially folded blank 20 travels in the direction A3 through the system 200, heat from the heater 203 heats an area of the blank 20 proximate the fold line 30, thereby increasing pliability of a material comprising and/or coating the blank. The blank 20 may subsequently, or at substantially the same time, be folded about the fold line 30 along direction A4 such that the attachment flap 32 of the blank 20 is pivoted relative to the second side panel 27 and at least partially overlaps the first side panel 25. Thereafter, or at substantially the same time, adhesive may be applied to one or more surfaces of the attachment flap 32 and/or first side panel 25 to partially form at interior of a sleeve formation 33, as shown. Adhesive may be applied through an adhesive applicator (not shown for clarity).

Figure 3A:
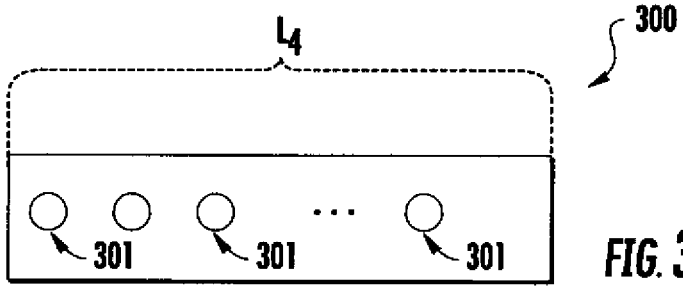
FIG. 3A-3C show different forms of heaters of the system of FIG. 1.
Figure 3B:
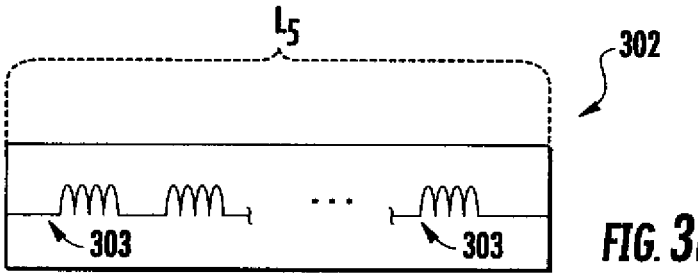
Figure 3C:
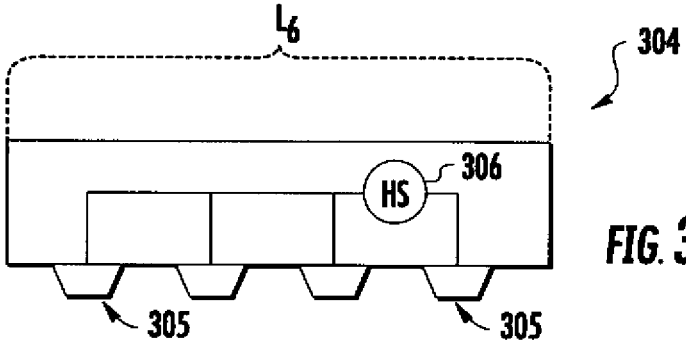

As described above, the heaters 3, 203 may take any suitable forms. As shown in FIGS. 3A-3C, the heaters 3, 203 may comprise an open flame heater 300 and/or electrical heater 302 and/or blower of heated air 304. The open flame heater 300 may include one or more nozzles 310 arranged about its length L4. The resistive heater 320 may include one or more resistive heating elements 330 or infrared elements arranged about its length L5. The blower of heated air 304 may include one or more nozzles 305 arranged about its length L6 for directing heated air from a heater/blower 306. Generally, the lengths L4, L5, and L6 may be arranged in registration with the fold lines 23, 30 described above, for example, to provide relatively even and repeatable heating characteristics. The arrangement of the heaters 300, 302, and 304 may be otherwise altered without departing from the scope of this disclosure. Additionally, the lengths L4, L5, and L6 could be significantly less than the length of the fold lines 23, 30 without departing from the scope of this disclosure.

Figure 4:
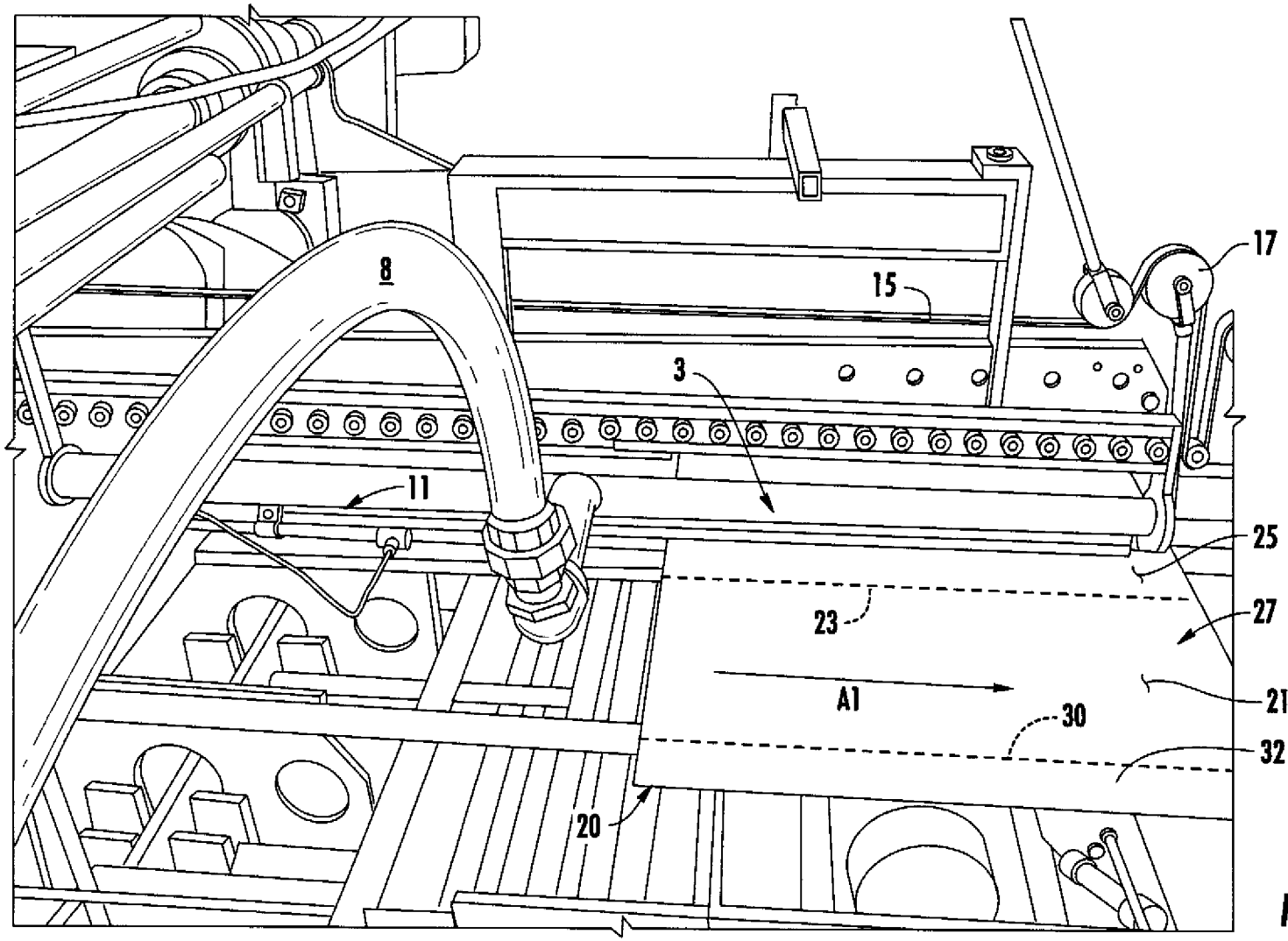
FIG. 4 is a detailed schematic of the system of FIG. 1.
Figure 5:
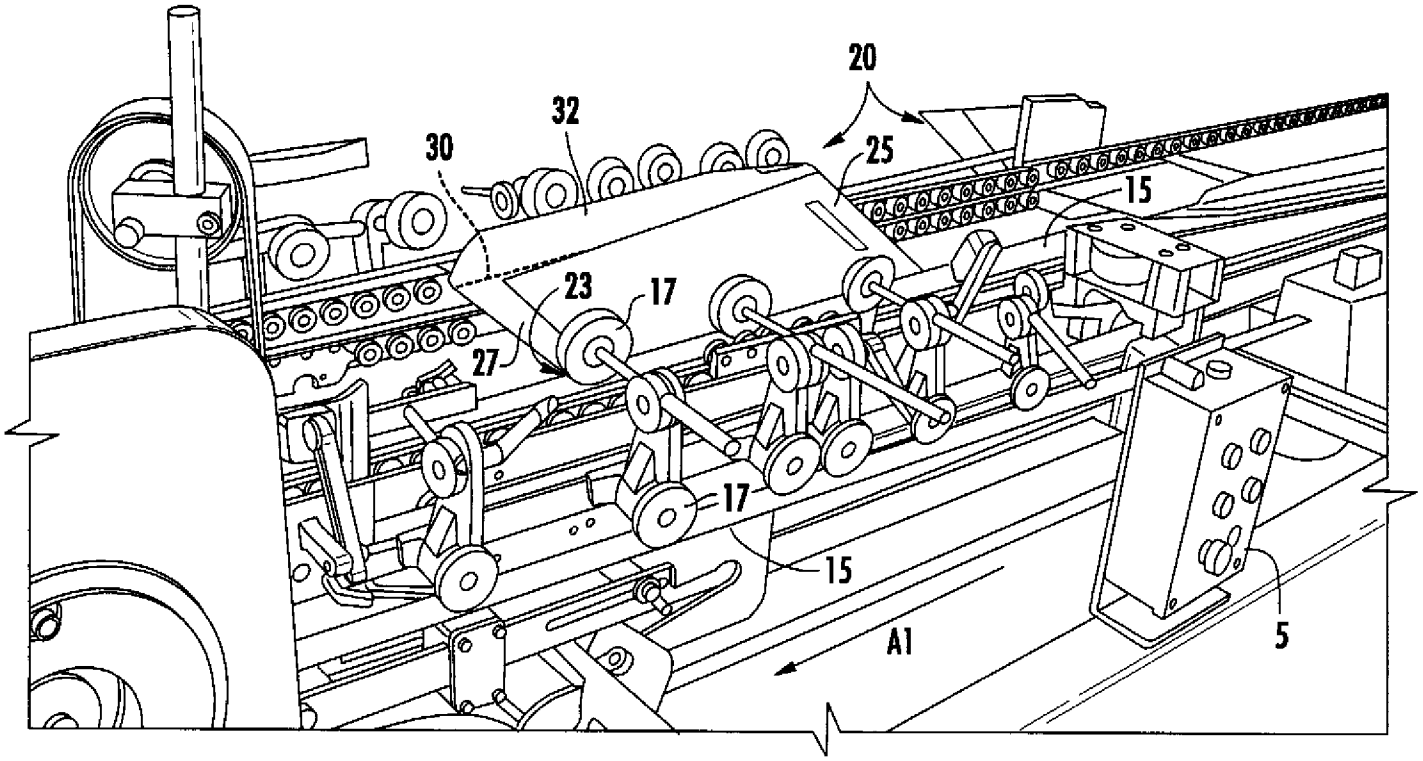
FIG. 5 shows the system of FIG. 4 partially forming a carton.

FIGS. 4-5 show a more detailed schematic of the systems 1, 2, 200. As shown, a carton blank 20 may travel within the system 1, 2, 200 to be folded about fold line 23. As shown in FIG. 5, multiple folds may be automated through use of the system 1, 2, 200. For example, the attachment flap 32 may be folded about fold line 30 and at least partially overlap the first side panel 25 to at least partially form an interior of a carton. The attachment flap 32 may also be adhered to the first side panel 25 in some embodiments. Adhering may be facilitated through use of heat-sealing with an additional heater (e.g., heater 203, not illustrated for clarity in FIG. 5) and/or adhesives. Adhering may be otherwise altered or configured without departing from the scope of this disclosure.

Figure 6:
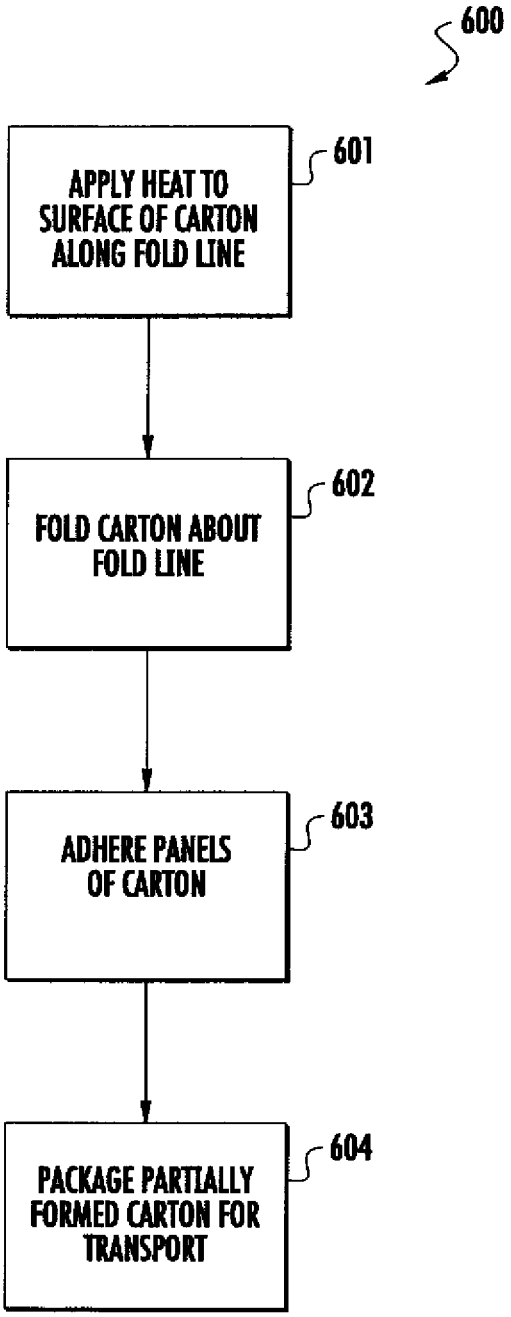
FIG. 6 is a flowchart of a method of heat-assisted carton formation, according to an embodiment.

Hereinafter, methods of at least partially forming cartons are described in detail with reference to FIGS. 6-7. As shown in FIG. 6, a method 600 of at least partially forming a carton may include obtaining a blank and applying heat to a surface of the blank along a fold line at step 601. The method 600 further includes folding the blank about the heated fold line at block 602 to partially form a carton. The method 600 further includes adhering panels of the partially formed carton at block 603 to form an interior of the carton. The method 600 further includes packaging the partially formed carton for transport at block 604.

Figure 7:
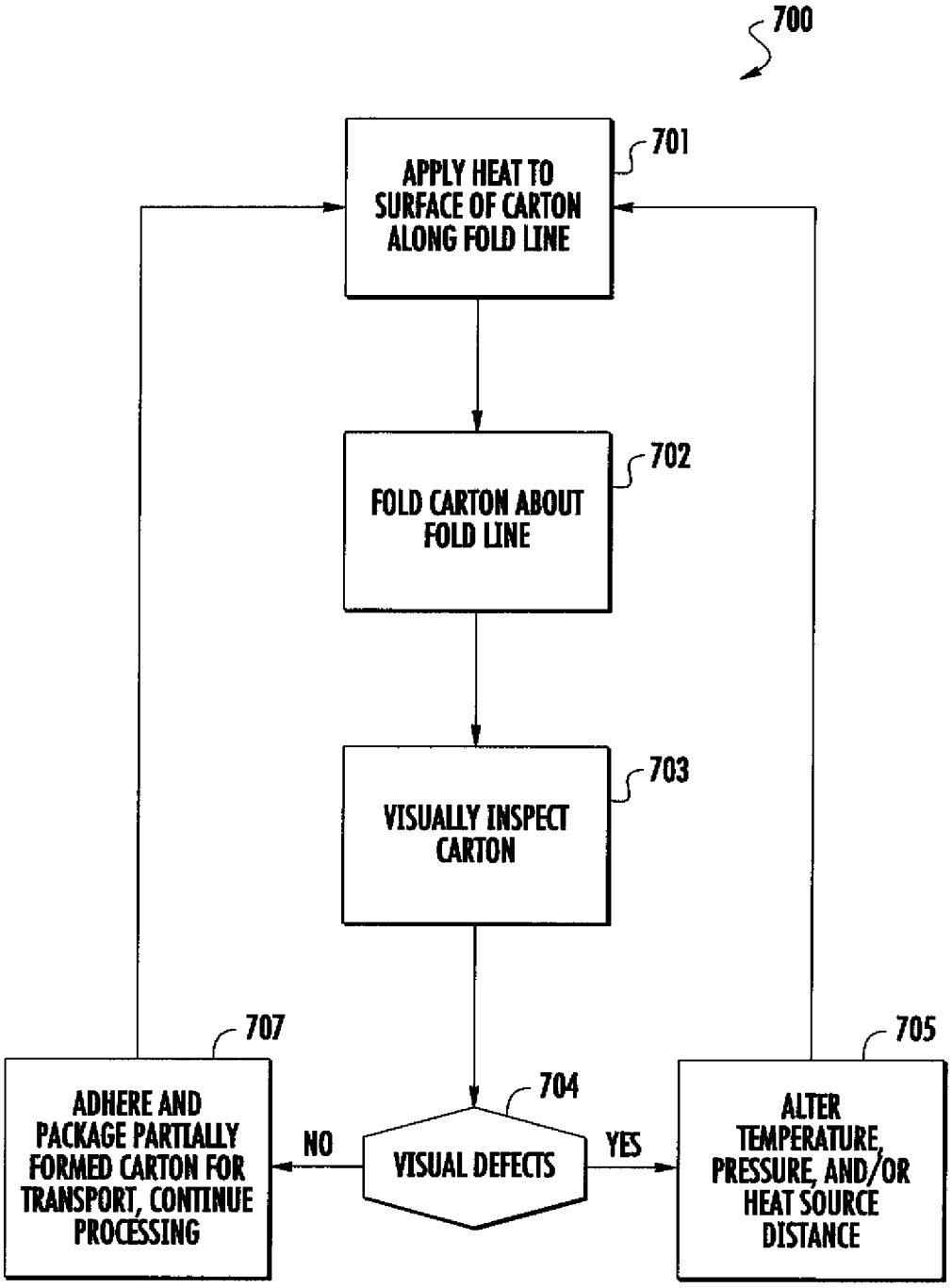
FIG. 7 is a flowchart of a method of heat-assisted carton formation, according to an embodiment.

As shown in FIG. 7, inspection operations may be implemented to maintain a visual quality of cartons processed with heat-assisted folding. For example, the method 700 for at least partially forming a carton may include applying heat to a surface of a blank along a fold line at step 701. The method 700 further includes folding the blank about the heated fold line at block 702 to partially form a carton. The method 700 further includes visually inspecting an outer surface and/or inner surface of the partially formed carton at step 703. If defects including visual defects are noted at step 704, the method 700 includes altering/adjusting a temperature, pressure, and/or distance of heater at step 705 to reduce or mitigate the visual defects prior to resuming operations at step 701. If no defects are noted at step 704, the method 700 includes adhering and packaging the partially formed carton, and continuing processing additional cartons at step 707, 701.

Figure 8:
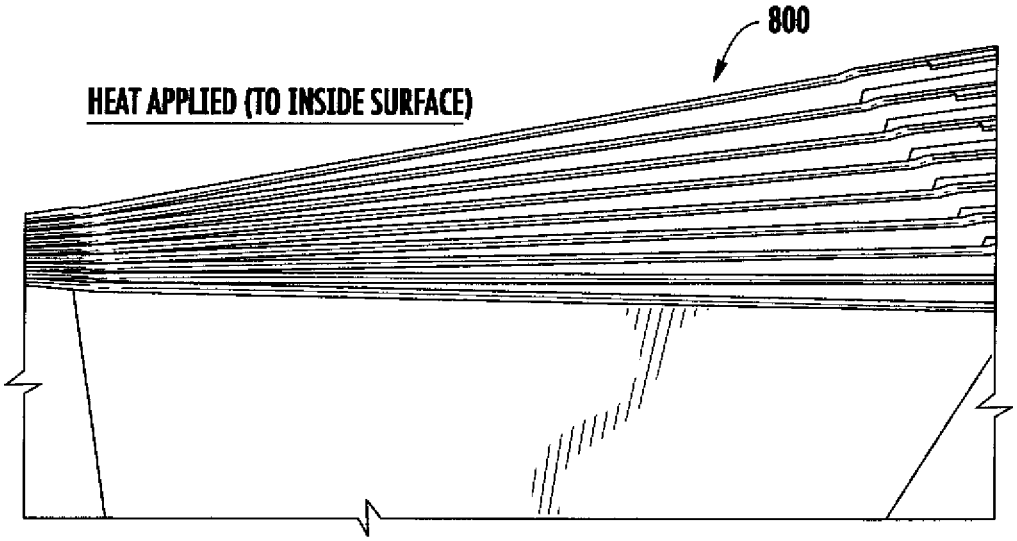
FIG. 8 depicts experimental results of heat-assisted carton formation.
Figure 9:
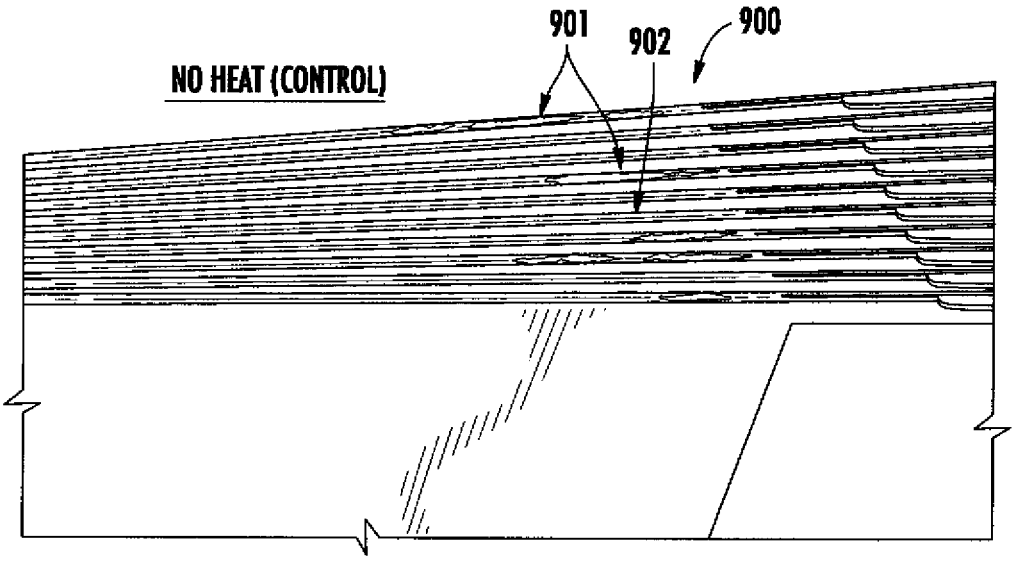
FIG. 9 depicts conventional carton formation results.
Figure 10:
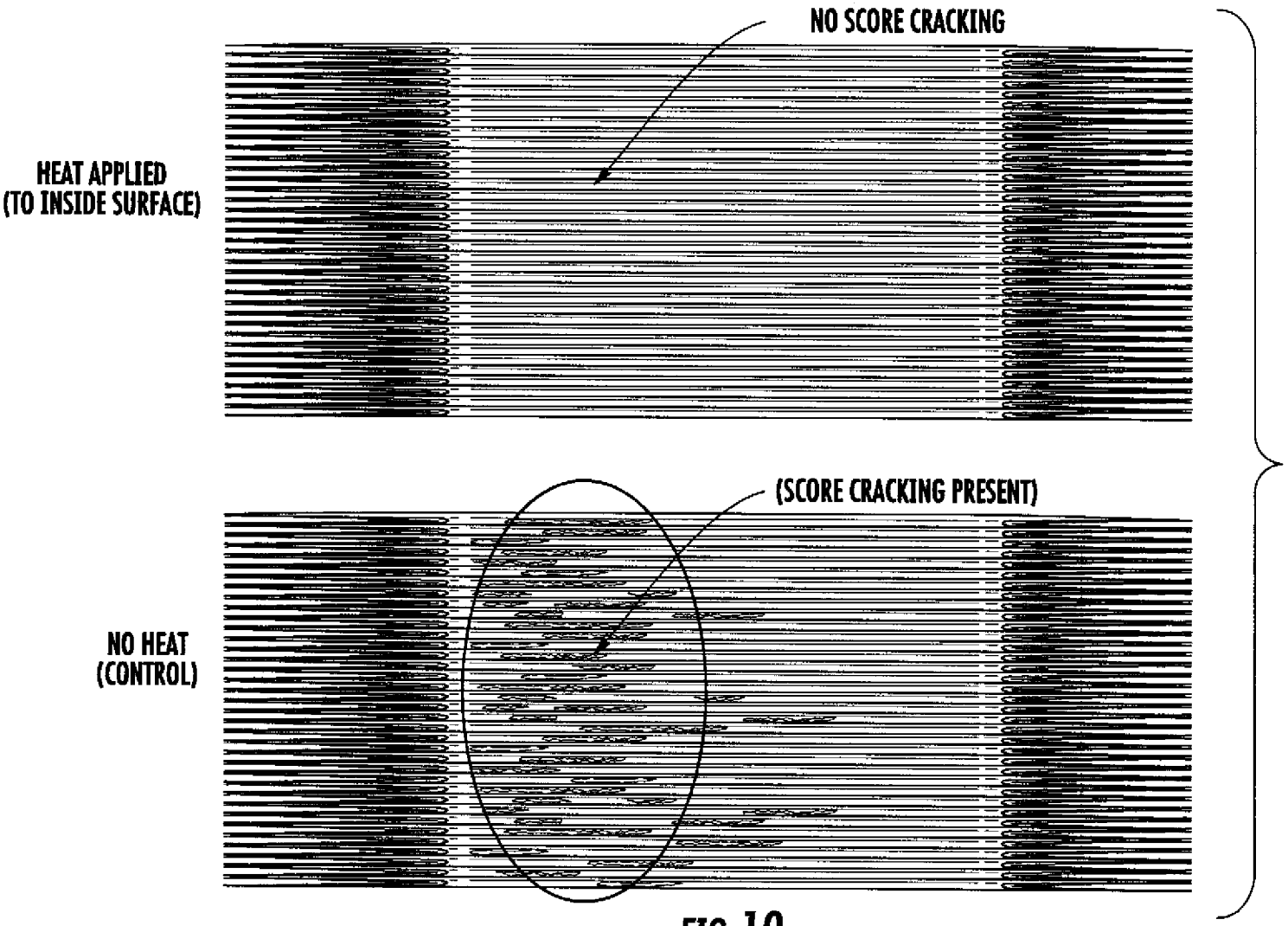
FIG. 10 compares heat-assisted carton formation results.

FIGS. 8-10 depict experimental results of heat-assisted folding operations as described above. As shown in FIG. 8, heat-assisted folded cartons 800 have little or no visual defects. In comparison, as shown in FIGS. 9-10, control folded cartons 900 (no heat-assisted folding) display a plurality of visual and surface defects 901, 902 including score cracking of coatings thereon.

In general, blanks may be constructed from cardboard having a caliper so that it is heavier and more rigid than ordinary paper. The blank can also be constructed of other materials, such as paperboard, or any other material having properties suitable for enabling the carton to function at least generally as described above. The blank can also include multiple layers of material or comprise liners and/or other blanks arranged thereon without departing from this disclosure. The blank or blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of at least partially assembling a carton from a blank, the method comprising:

obtaining a blank comprising at least one fold line, the blank comprising paperboard, an exterior surface having a coating, and an interior surface free from the coating;

obtaining a heater;

positioning the blank comprising the at least one fold line proximate the heater;

operating the heater, after positioning the blank comprising the at least one fold line proximate the heater, and heating the interior surface of the blank, the heating the interior surface comprises heating the at least one fold line to form an at least one heated fold line, during the heating the at least one fold line is spaced apart from the heater; and folding the blank, after heating the at least one fold line, about the at least one heated fold line to form a partially assembled carton, during the folding the blank is spaced apart from the heater.

2. The method of claim 1, further comprising moving the blank proximate the heater in a direction of the at least one fold line, wherein during the heating the interior surface of the heater is free from contact with the blank.

3. The method of claim 2, wherein the heater is configured to heat the interior surface of the blank to within a predetermined range of temperatures.

4. The method of claim 1, wherein the at least one fold line foldably connects at least a first panel and a second panel of the blank.

5. The method of claim 4, the folding the blank further comprising folding the first panel to be in at least partial face-to-face contact with the second panel.

6. The method of claim 5, further comprising adhering an attachment flap foldably connected to the second panel to at least a portion of the first panel to form a sleeve for the partially assembled carton.

7. The method of claim 6, further comprising packaging the sleeve into a packaging system for transporting a plurality of sleeves for a plurality of cartons.

8. The method of claim 1, further comprising visually inspecting the outer surface of the partially assembled carton proximate the heated fold line.

9. The method of claim 8, further comprising determining if visual defects exist on the outer surface about the heated fold line.

10. The method of claim 9, further comprising adhering and packaging the partially assembled carton in the absence of visual defects or altering a heating parameter in the presence of visual defects.

11. The method of claim 10, wherein the heating parameter includes at least one of a temperature of the heater and a distance between the heater and the at least one fold line.

12. The method of claim 11, wherein the heater is at least one of a flame burner, a resistive heating element, and a blower of heated air.

13. The method of claim 12, wherein the heater comprises a flame burner, and wherein altering the heating parameter includes adjusting a gas feed to the flame burner.

14. The method of claim 12, wherein the heater comprises a resistive heating element, and wherein altering the heating parameter includes adjusting a level of current/voltage to the resistive heating element.

15. The method of claim 12, wherein the heater comprises a blower of heated air, and wherein altering the heating parameter includes adjusting an output air flow of the blower of heated air.

16. The method of claim 1, wherein during the heating, the heater is coplanar with the at least one fold line and the heater has a length along an axis, the axis is in alignment with the at least one fold line.

17. A method of reducing visual defects of an outer surface of a carton assembled from a coated paperboard blank, the method comprising: obtaining a blank having an inner surface, an outer surface, the outer surface having a coating applied thereon, a first side panel foldably connected to a second side panel at a first fold line, and an attachment flap foldably connected to the second side panel at a second fold line; obtaining a heater; positioning the blank proximate the heater; operating the heater, after positioning the blank comprising the first fold line and the second fold line proximate the heater, and heating the inner surface of the blank along the first fold line to form a first heated fold line, during the heating the first fold line is spaced apart from the heater; positioning the first side panel to be in at least partial face-to-face contact with the second side panel by folding the blank at the first heated fold line, during the folding the blank is spaced apart from the heater; operating the heater, after positioning the blank comprising the first fold line and the second fold line proximate the heater, and heating the inner surface of the blank along the second fold line to form a second heated fold line, during the heating the second fold line is spaced apart from the heater; positioning the attachment flap to at least partially overlap the first side panel by folding the blank at the second heated fold line, during the folding the blank is spaced apart from the heater; and adhering overlapping portions of the attachment flap and the first side panel; wherein the inner surface of the blank is devoid of coating.

* * * * *